US006113405A

United States Patent [19]

Zehrung

[11] Patent Number: 6,113,405

[45] Date of Patent: Sep. 5, 2000

[54] POWER DOOR LOOP

[76] Inventor: Raymond E. Zehrung, 131 Serena Way, Santa Clara, Calif. 95051

[21] Appl. No.: 09/293,138

[22] Filed: Apr. 16, 1999

[51] Int. Cl.[7] ..... H01R 3/00; H01R 13/73

[52] U.S. Cl. ..... 439/164; 439/552

[58] Field of Search ..... 439/164, 552, 439/557, 558; 174/65 R; 200/295, 296

[56] References Cited

U.S. PATENT DOCUMENTS

| | | | |
|---|---|---|---|
| Re. 35,820 | 6/1998 | Guginsky | 174/102 |
| 1,699,560 | 1/1929 | Bourgon . | |
| 3,053,564 | 9/1962 | Evans et al. . | |
| 3,151,905 | 10/1964 | Reuther et al. . | |
| 3,848,361 | 11/1974 | Foster et al. | 49/167 |
| 4,198,537 | 4/1980 | Mariani | 174/65 R |
| 4,445,299 | 5/1984 | Lehikoinen et al. | 49/167 |
| 4,800,648 | 1/1989 | Nakayama et al. | 29/854 |
| 4,840,584 | 6/1989 | Cox | 439/538 |
| 4,862,011 | 8/1989 | Wright | 307/10.1 |
| 4,869,670 | 9/1989 | Ueda et al. | 439/34 |
| 4,907,836 | 3/1990 | Ueda et al. | 276/39.1 |
| 5,092,647 | 3/1992 | Ueda et al. | 296/146 |
| 5,283,393 | 2/1994 | Guginsky | 174/102 |
| 5,466,036 | 11/1995 | Stroeters et al. | 296/208 |
| 5,584,144 | 12/1996 | Hisano | 49/502 |
| 5,607,323 | 3/1997 | Foster et al. | 439/557 |
| 5,690,501 | 11/1997 | Mader | 439/165 |
| 5,716,044 | 2/1998 | Peterson et al. | 296/152 |
| 5,753,863 | 5/1998 | Grajewski et al. | 174/151 |
| 5,761,851 | 6/1998 | Biddlecombe | 49/502 |
| 5,914,665 | 6/1999 | Thorp et al. | 340/69.1 |

OTHER PUBLICATIONS

Alarm Lock Corporation Door Loop, Sales Brochure for model 271, Alarm Lock Corporation, Parsippany, New Jersey, No Date.

Keedex Armored Door Loops, Sales Brochure for models K–DLA, K–DLB, K–DLG, K–DLW, K–DLA24, K–DLB24, K–DL38A, K–DL38B, K–DL38A24, K–DL38B24, Keedex Inc. of Garden Grove, California, No Date.

Locknetics Door Loops, Sales Brochure for model 788 Series, Locknetics Security Engineering a Harrow Company, Oxford, Michigan, No Date.

SDC Accessories Power Transfer Devices, Sales Brochure for models PT–1 and PT–2, Security Door Controls (SDC), Westlake Village, California, No Date.

Von Duprin Accessories Door Loop, Sales Brochure for models DL–7 and DL–12, Von Duprin, Inc., Indianapolis Indiana, No Date.

*Primary Examiner*—Lincoln Donovan
*Assistant Examiner*—Chandrika Prasad
*Attorney, Agent, or Firm*—David R. Gildea

[57] ABSTRACT

A power door loop for providing an electrical connection between a pivoting door and a wall. The door loop includes one or more wires, a flexible armored cable, and housings at each end of the cable. Each housing has a circular bottom end and a perpendicular cylindrical wall. The cable connects into the cylindrical wall. A sleeve having snap latches projects from the bottom end. The wires pass into one sleeve, make a right angle bend in the housing, pass through the cable, make a right angle bend in the other housing, and pass out of the other sleeve. For installation, holes are made in the outer layer of the wall and door for routing or fishing the wires to their destinations. The bottom end of the housing is positioned over the outer surface layer of the door or wall with the sleeve juxtaposed against the hole and the sleeve and wires are inserted through the hole. The snap latches allow the sleeve to slide through the hole and then spring into a retaining position when the sleeve is past the lip of the hole for catching against the underside of the outer layer of the door or wall.

20 Claims, 2 Drawing Sheets

POWER DOOR LOOP

BACKGROUND OF THE INVENTION

1. Field of the Invention

The invention relates generally to power door loops that provide electrical connection between a pivoting door and a wall and more particularly to a power door loop having a circular snap-in housing with an integral wire protection sleeve.

2. Description of the Prior Art

Door loops are well known for transmitting electricity from a wall to a pivoting door. Such door loops commonly transmit power or signals through conductive wires enclosed and shielded in a flexible armored cable. The cable with the enclosed wires is then looped between the wall and the pivoting door in such a way that the loop accommodates the change in distance and direction between points of attachment on the wall and the door when the door is opened and closed. The ends of the cable terminate in housings. In order to install the door loop, holes are made in the surface layers of the wall or jamb and the door for routing or fishing the wires to their destinations. The wires are passed into the holes and then the housings are fixed in place with fastenings so that the housings cover the holes. A potential cause of failure in such door loops is that the wires may chafe against the lip of the hole. Another potential cause of failure is that excessive flexing may cause the cable to break, especially where there are sharp bends in the cable. For best reliability it is desirable to eliminate sharp bends and minimize flexing of the cable as the door is opened and closed. It is generally desirable for the cable to make a broad loop that is as nearly as possible in a plane that is parallel to the door in both open and closed positions. Difficulties with the installation in such door loops are frequently encountered in finding places on the wall and door where there is enough surface space for the housing and the housing can be oriented so that the cable lead into the housing does not have a sharp bend. Furthermore, the appearance of the installation can appear haphazard unless the sides of the housing align with the edges of the jamb or door. Unfortunately, in some installations the desire for a pleasing appearance conflicts with a requirement for minimizing bending. Even neglecting appearance, the installation of existing door loops requires a high level of skill and is relatively time consuming for planning locations of the fastenings so that the housings are correctly oriented before fixing the housings in place. There is a need for a door loop that is improved by being more reliable and easier to install.

SUMMARY OF THE INVENTION

It is therefore an object of the present invention to provide a door loop having a housing having a circular cross-section in a plane parallel to a door or wall to which the housing is fixed.

Another object of the present invention is to provide a door loop housing having a sleeve for projecting through a hole in the outer surface layer of a door or wall for protecting wires from the lip of the hole.

Another object of the present invention is to provide a door loop having a housing having a sleeve having a snap latch that allows the sleeve to be pushed through a hole in an outer surface layer of a door or wall and then retains the housing to the door or wall.

Briefly, in a preferred embodiment, a door loop of the present invention includes one or more wires, a flexible armored cable, and housings at each end of the cable. The wires in the door loop transfer power or signals between a wall and a door. Each housing has a circular bottom end and a perpendicular cylindrical wall. The cable connects into the cylindrical wall. A sleeve having snap latches projects from the bottom end. The wires enter into one sleeve, make a right angle bend in the housing, pass through the cable, make a right angle bend in the other housing, and exit from the other sleeve. For installation, holes are made in the outer layers of the wall and door for routing or fishing the wires through a hollow center section or a longitudinal hole to their destinations. The bottom end of the housing is positioned over the outer surface layer of the door or wall with the sleeve juxtaposed against the hole and the sleeve and wires are pushed into the hole. The snap latches allow the sleeve to slide through the hole and then spring into a retaining position when the sleeve is past the lip of the hole by catching against the underside of the outer layer of the door or wall. A cover press fits over the housing so that the installation of the door loop to the door or wall does not require the installer to use screws.

An advantage of the door loop of the present invention is that a circular housing at the end of a cable enables the housing to be placed and oriented so that the bending and flexing of a cable minimized when a door opens and closes without having a haphazard look due to an apparent misalignment of the sides of the housing against the straight edges or a jamb or door.

Another advantage of the door loop of the present invention is that a sleeve projecting through a hole in a door or wall protects wires from chafe against the lip of the hole.

Another advantage of the door loop of the present invention is that a housing has snap latches for retaining the housing against the door or wall while enabling the housing to be quickly mounted.

Another advantage is that the snap latch of the present invention allows a housing to be turned after it is mounted in order to align the cable for minimizing bends and flexing.

These and other objects and advantages of the present invention will no doubt become obvious to those of ordinary skill in the art after having read the following detailed description of the preferred embodiments which are illustrated in the various figures.

DETAILED DESCRIPTION OF THE PREFERRED EMBODIMENTS

Figure 1A:
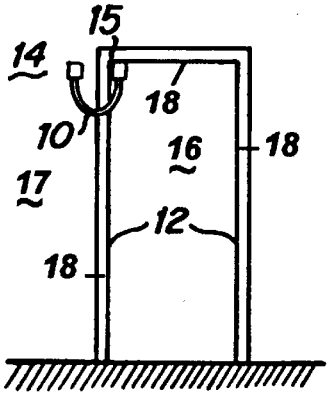
FIGS. 1*a* is a drawing of the power door loop of the present invention installed for transferring power or signals between a wall and a pivoting door.
Figure 1B:
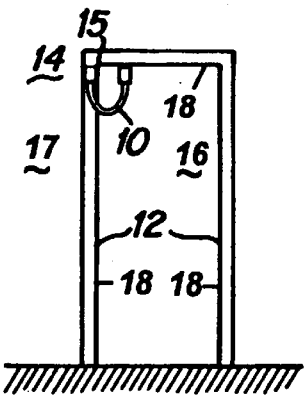
FIG. 1*b* is a drawing of another installation of the power door loop of the present invention.
Figure 2:
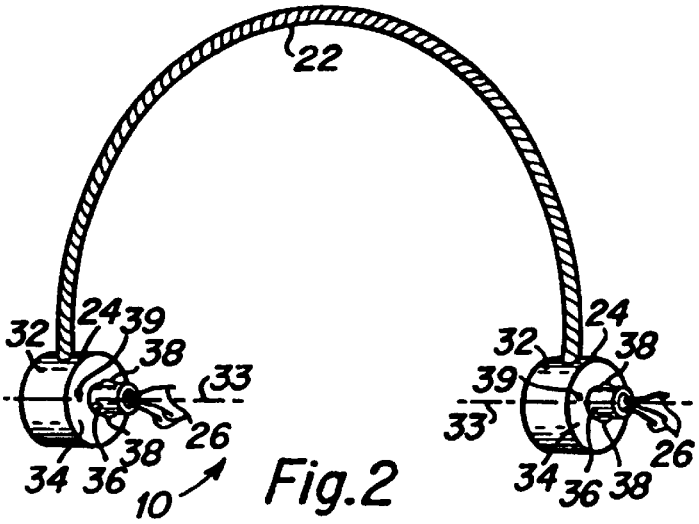
FIG. 2 is a perspective view of the door loop of the present invention.

FIGS. 1*a* and 1*b* are drawings of the power door loop of the present invention referred to by the general reference number 10 mounted for power connection between two external members typically a pivoting member usually a door 12 and a stationary member usually a wall 14 having open face sides 16 and 17, respectively, and jamb sides 18 perpendicular to the open face sides 16 and 17. Typically, the external members have a straight edges having a separation 15 where they are attached by hinges, a pivot rod, or the like. The door 12 and/or the wall 14 may be constructed of metal, wood, or some other material. Referring to FIG. 2, the door loop 10 includes a flexible armored cable 22, housings 24 at the ends of the cable 22, and wires 26. Typically, the door loop 10 is used for transferring electrical energy for power and/or signals. However, optical energy could be transferred where one or more of the wires 26 is a fiber optic line; or a gas or fluid could be passed though small tubes in place of the wires 26. Each housing 24 includes a cylindrical wall 31 (FIGS. 4*a–c*) having a cover 32. The cylindrical wall 31 and the cover 32 have a center axis 33. The cable 22 connects at a right angle into the cylindrical wall 31. The housing 24 further includes a flat circular bottom end 34 at a right angle to the axis 33. The bottom end 34 includes an aperture 35 centered about the axis 33. A sleeve 36 encloses the aperture 35 and projects at a right angle from the bottom end 34 about the center axis 33. The wires 26 enter and exit the housings 24 through the open end of the sleeve 36 and the aperture 35, make a right angle turn within the housing 24, and pass through the cable 22. The sleeve 36 includes a snap latch 38 for retaining the housing 24 against the door 12 or wall 14. However, the bottom end 34 also includes screw holes 39 for accommodating screws for attaching the housing 24 to the door 12 or wall 14 when attachment with the snap latch 38 is not practical or in addition to the attachment with the snap latch 38. Typically, screws are used where the door 12 and/or wall 14 are constructed of wood. The snap latch 38, with or without additional fastening screws, is used where the door 12 and/or wall 14 is constructed of metal.

Figure 3:
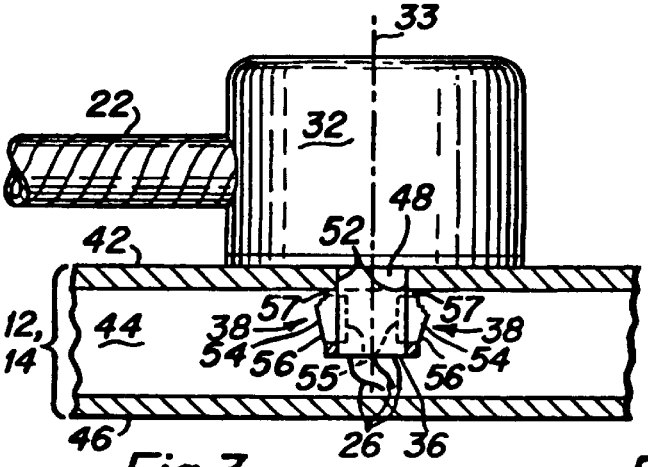
FIG. 3 is a side view of one end of the door loop of the present invention installed against a door or a wall.

FIG. 3 is a side view of one end of the door loop 10 showing the door loop 10 installed against the door 12 or wall 14. The door 12 and/or wall 14 shown in cross-section includes an outer layer 42 of the open face side 16 or 17, a hollow section 44, and an inner layer 46. The hollow section 44 may be not actually be hollow but may instead be a core of a different material than the outer layer 42. The hollow section 44 may be part of the construction of the door 12 or wall 14 or may by a longitudinal wiring hole bored in the door 12 or wall 14. The wires 26 are routed or fished through the hollow section 44 to their destinations. A hole 48 defined by a lip 52 having a diameter or length and width slightly greater than the sleeve 36 is made in the outer layer 42. The door loop 10 is installed by positioning the bottom end 34 of the housing 24 above the outer layer 42 with the sleeve 36 juxtaposed to the hole 48 and pushing the sleeve 36 into the hole 48. When the sleeve 36 has been pushed though the hole 48, the snap latch 38 latches and retains the housing 24 to the door 12 or wall 14. In a preferred embodiment, the snap latch 38 includes spring fingers 54 and a cutout 55 on the sleeve 36 arranged so that one set of fingers 54 and one cutout 55 is across the sleeve 36 from another set of fingers 54 and another cutout 55. Each of the fingers 54 includes a lower end 56 attached to the sleeve 36 distal from the bottom end 34 and an upper end 57. The cutouts 55 are inward of and larger than the fingers 54. Each finger 54 cantilevers from the sleeve 36 at the lower end 56 and extends upward toward the bottom end 34 of the housing 24 and slightly outward from the sleeve 36 to the upper end 57. When the sleeve 36 is pushed into the hole 48, the lip 52 pressing on the finger 54 overcomes a natural springiness of the finger 54 to push the finger 54 inward in the cutout 55. When the upper end 57 of the finger 54 has passed beyond the lip 52, the finger 54 springs outward so that the upper end 57 catches against the underside of the outer layer 42 and holds the housing 24 against the door 12 or wall 14. While the snap latch 38 holds the housing 24, the housing 24 can be turned about the sleeve 36 to any angle in order to align the cable 22 for the least bending and flexing of the cable 22 as the door 12 opens and closes. Optionally, after the cable 22 is aligned, the screw holes 39 (FIGS. 2 and 4*c*) can be used to fasten the housing 24 in place. The housing 24 is covered by the cover 32 having a top and a cylindrical side coaxial with the axis 33. It should be noted that the sleeve 36 protects the wires 26 from chafe due to contact with the lip 52 of the hole 48 in the surface layer of the door 12 or wall 14 whatever the construction of the door 12 or wall 14, for example, when the outer layer 42 is a layer of metal over a core of a different material or the door 12 or wall 14 is a solid material, such as wood.

Figure 4A:
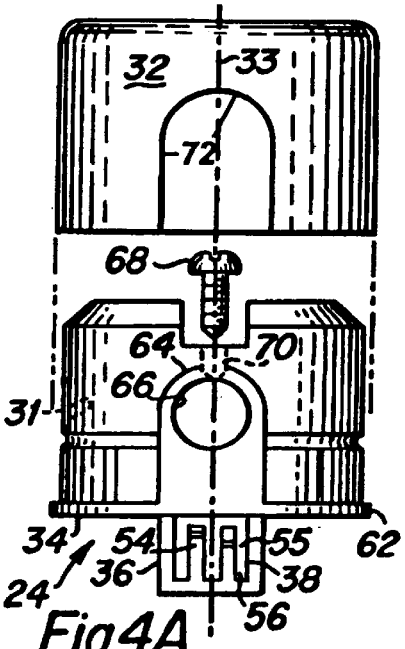
FIGS. 4*a*, 4*b*, and 4*c* are an expanded first side view, a cross-sectional second side view, and a bottom view, respectively, of a housing of the door loop of the present invention.
Figure 4B:
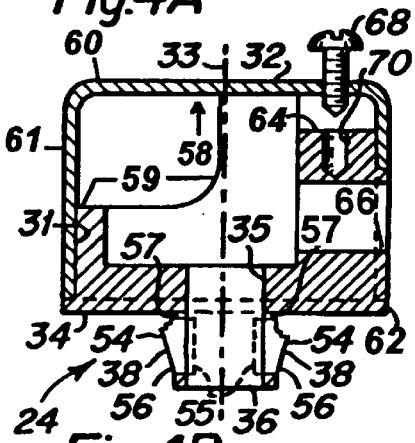
Figure 4C:
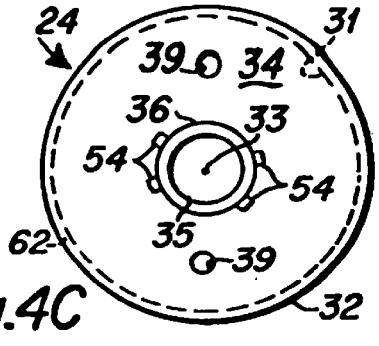

FIGS. 4*a*, 4*b*, and 4*c* are a first side view, a second side cross-sectional view, and a bottom view, respectively, of the housing 24 of the present invention for the door loop 10 showing the cylindrical wall 31 including an open top end 58 and a cutout 59, the axis 33, the circular bottom end 34, the sleeve 36, the aperture 35, the snap latch 38, screw holes 39, the cutouts 55 and the lower and upper ends 56 and 57, respectively, of the fingers 54 as described above. The cover 32 including a substantially flat cover top 60 and a substantially cylindrical cover side 61, press fits snugly into the housing 24 and rests against a bottom flange 62 after the cable 22 has been connected. The cylindrical wall 31 of the housing 24 includes a pedestal 64 having a cable connection receptacle 66, a screw 68, and a screw hole 70. The screw 68 is tapped into the screw hole 70 to hold the cable 22 in the cable connection receptacle 66. The cover side 61 of the cover 32 includes a slotted cover opening 72 having a shape for accepting the pedestal 64 and allowing the cable 22 to pass to the cable connection receptacle 66.

Figure 5A:
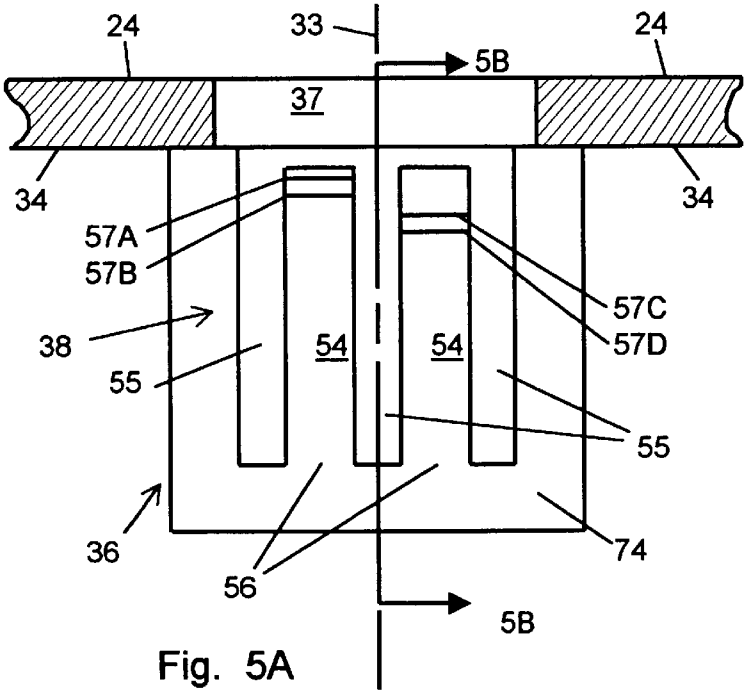
FIGS. 5*a* and 5*b* are large scale views corresponding to 4*a* and 4*b*, respectively, of a sleeve and snap latch of the present invention.
Figure 5B:
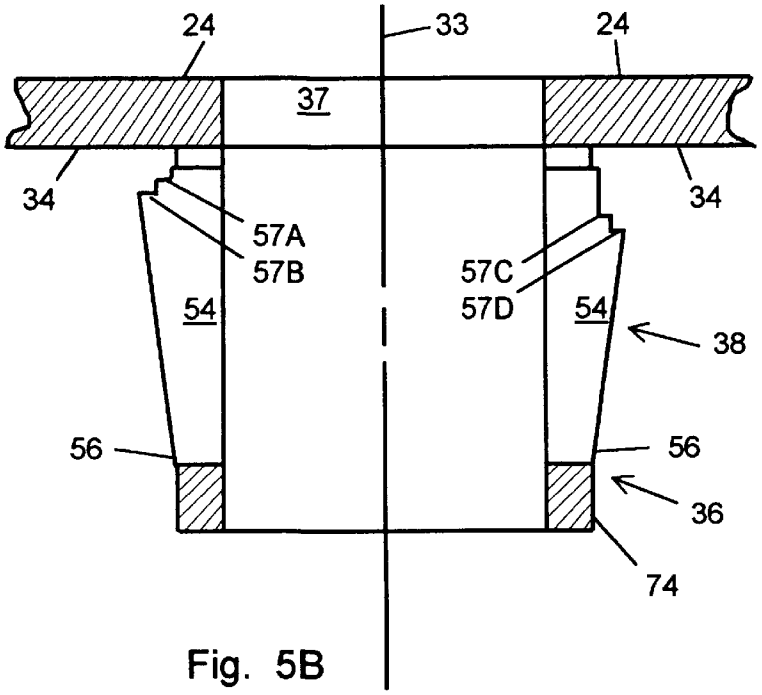
Figure 5C:
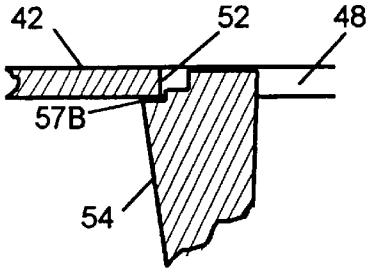
FIG. 5*c* is a cross-sectional view of the snap latch of FIGS. 5*a*–*b* latched against the underside of an outer layer of a door or wall.

FIGS. 5*a* and 5*b* are an expanded first side view corresponding to FIG. 4*a* and an expanded second side cross-sectional view corresponding to FIG. 4*b*, respectively, showing the sleeve 36 and the snap latch 38 of the present invention. The sleeve 36 projects downward from the aperture 35 of the bottom end 34 of the housing 24 along the axis 33 to a distal end 74 having a continuous circular cross-section where the lower ends 56 of the fingers 54 are attached. Two pairs of fingers 54, each pair arranged across the sleeve 36 from the other pair, project upward and slightly outward from the lower end 56 of the fingers 54. The fingers 54 are separated from the sleeve 36 by the cutouts 55 except at the lower ends 56. The upper ends 57 of the fingers 54 have notches 57*a–d* for catching on the underside of the outer layer 42 at the lip 52 as shown in FIG. 5*c*. Each of the notches 57*a–d* has a certain distance from the bottom end 34 in order to accommodate different thicknesses for the outer layer 42. For example, a steel door 12 may have an outer layer 42 having a thickness of 1/16 inch and an aluminum door 12 may have an outer layer 42 having a thickness of 1/8 inch. In a preferred embodiment, the notches 57*a–d* are disposed for the outer layer 42 of 1/16 inch for notch 57*a*, 3/32 inch for notch 57*b*, 1/8 inch for notch 57*c*, and 5/32 for notch 57*d*. Preferably, the distances between the notches 57*a–d* and the bottom end 34 are slightly greater, such as 0.006 inches, than the thicknesses of the outer layers 42 for which the respective notches 57*a–d* are expected to latch. FIG. 5*b* shows the fingers 54 sprung outward. When the sleeve 36 has been inserted into the hole 48, the lip 52 catches on the notch 57*a–d* that corresponds to the thickness of the outer layer 42 at the lip 52 and underside of the outer layer 42. FIG. 5*c* is an expanded cross-sectional view of the finger 54 and the outer layer 42 showing the notch 57*a* latched to the lip 52 and the underside of the outer layer 42.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A door loop comprising:

a cable;

a housing connected at one end of the cable, the housing having a bottom end and a sleeve having a distal end, said sleeve projecting downwardly from said bottom end to said distal end;

said sleeve having a first pair of spring fingers and a second pair of spring fingers, each of said fingers of said first pair having a first lower end attached to said sleeve at said distal end and a first upper end proximate to said bottom end, each of said fingers of said second pair having a second lower end attached to said sleeve at said distal end and a second upper end proximate to said bottom end; said first upper end having a first notch at a first distance from said bottom end; and said second upper end having a second notch at a second distance from said bottom end, said second distance not equal to said first distance.

2. The door loop of claim 1, wherein:

said distal end has a continuous cross-section.

3. The door loop of claim 2, wherein:

said bottom end is for placement flat against an external member;

said sleeve is for insertion into a round hole in said external member, said sleeve having a center axis about which said housing can turn; and further comprising:

at least one wire routed through said sleeve completely surrounded by said distal end of said sleeve.

4. The door loop of claim 3, wherein:

the housing includes a substantially cylindrical housing wall projecting upwardly from said bottom end to an open top end, said housing wall including a pedestal having a cable receptacle for attaching the cable to the housing; and further comprising:

a top cover having a cylindrical cover side for covering said housing, said cover side having a slotted cover opening for accepting said pedestal and allowing the cable to pass to said cable receptacle.

5. The door loop of claim 4, wherein:

said housing wall further includes a cutout for accessing said wire within said housing when said top cover is removed.

6. A door loop for connecting power between pivotally engaged members, said members having respective jamb sides facing the other of said members and respective open face sides substantially perpendicular to said jamb sides, comprising:

a cable including at least one wire;

a housing including a bottom end for disposal against one of said open face sides and a cylindrical housing wall having a cable receptacle for attaching to the cable, said housing wall projecting upwardly from said bottom end to an open top end for accessing said wire; and a removable top cover for covering said open top end, the top cover having a cylindrical cover side having a cover opening for allowing said cable to pass to said cable receptacle.

7. The door loop of claim 6, wherein:

said housing wall further includes a cutout for accessing said wire.

8. The door loop of claim 6, wherein:

said housing wall includes a pedestal having said cable receptacle; and said cover opening is slotted for accepting said pedestal as said top cover is pressed onto said housing.

9. The door loop of claim 6, wherein:

said housing further includes a sleeve projecting downwardly from said bottom end to a distal end having a round continuous cross-section, said sleeve for insertion into a round hole in one of said respective open face sides.

10. The door loop of claim 6, wherein:

said bottom end includes holes accessible through said open top end for allowing said housing to be fastened in place to one of open face sides.

11. A method for transferring power, comprising steps of:

providing a housing connected to one end of a cable, said housing having a bottom end and a sleeve having a distal end, said sleeve projecting downwardly from said bottom end to said distal end, said sleeve having a first of spring fingers, each of said fingers of said first pair having a first lower end attached to said sleeve at said distal end and a first upper end proximate to said bottom end, each of said fingers of said second pair having a second lower end attached to said sleeve at said distal end and a second upper end proximate to said bottom end, said first upper end having a first notch at a first distance from said bottom end, and said second upper end having a second notch at a second distance from said bottom end, said first distance different than said second distance;

inserting said sleeve through a hole in a surface layer of an external member; and retaining said housing against said surface layer by catching either said first notch or said second notch against an underside of said surface layer depending upon a thickness of said surface layer.

12. The method of claim 11, wherein:

said distal end has a continuous cross-section.

13. The method of claim 12, further comprising steps of:

making a round hole in said surface layer; and routing at least one wire through said distal end into said external member; and wherein:

the step of inserting said sleeve includes steps of inserting said sleeve into said round hole and turning said housing about a center axis of said sleeve.

14. The method of claim 13, wherein:

said housing further includes a substantially cylindrical housing wall projecting upwardly from said bottom end to an open top end, said housing wall including a pedestal having a cable receptacle for attaching said cable to said housing; and further comprising a step of:

covering said housing with a top cover having a substantially cylindrical cover side having a slotted cover opening for accepting said pedestal and allowing said cable to pass to said cable receptacle.

15. The method of claim 14, further comprising steps of:

removing said top cover; and accessing said wire through said open top end and a cutout in said housing wall.

16. A method of connecting power between pivotally engaged members, each of said members having a jamb side facing the other of said members and an open face side substantially perpendicular to said jamb side, comprising steps of:

providing a door loop having housings having respective bottom ends and respective cylindrical housing walls projecting upwardly from said bottom ends to respective open top ends, said housing walls having respective cable receptacles;

connecting respective ends of a cable having at least one wire to said cable receptacles;

accessing said wire through at least one of said open top ends;

placing said bottom ends flat against said open face sides, respectively;

covering said open top ends with respective removable top covers having respective cylindrical cover sides having respective cover openings for allowing said cable to pass to said respective cable receptacles.

17. The method of claim 16, further comprising step of:

removing said top cover; and accessing said wire through a cutout and said open top end in at least one of said housing walls.

18. The method of claim 16, wherein:

at least one of said housing walls includes a pedestal having said respective cable receptacle; and at least one of said cover openings is slotted for accepting said pedestal as said top cover is pressed onto said housing.

19. The method of claim 16, further comprising a step of:

providing said housing further having a sleeve projecting downwardly from said bottom end to a distal end having a round continuous cross-section:

making a round hole in at least one of said open face sides; and inserting said sleeve into said round hole.

20. The method of claim 16, further comprising a step of:

fastening at least one of said housings in place to one of said open face sides though holes in one of said bottom ends, said holes accessible through said open top end by removing said top cover.

* * * * *